US008627838B2

(12) United States Patent
Delaney et al.

(10) Patent No.: US 8,627,838 B2
(45) Date of Patent: Jan. 14, 2014

(54) ROTARY IMPINGEMENT CLEANING APPARATUS FOR SANITARY ENVIRONMENTS

(75) Inventors: Robert E. Delaney, Kennett Square, PA (US); Andrew K. Delaney, West Chester, PA (US); Johnny A. DeBeaupre, Elverson, PA (US); Suneeth D. A. Molugu, Devon, PA (US)

(73) Assignee: Alfa Laval Tank Equipment, Inc., Richmond, VA (US)

( * ) Notice: Subject to any disclaimer, the term of this patent is extended or adjusted under 35 U.S.C. 154(b) by 942 days.

(21) Appl. No.: 12/799,031

(22) Filed: Apr. 17, 2010

(65) Prior Publication Data

US 2011/0079254 A1 Apr. 7, 2011

Related U.S. Application Data

(60) Provisional application No. 61/278,067, filed on Oct. 2, 2009.

(51) Int. Cl.
*B08B 3/12* (2006.01)

(52) U.S. Cl.
USPC ..... 134/198; 134/167 R; 134/166 R; 134/22.1; 134/172; 239/237; 239/240; 239/242; 239/206

(58) Field of Classification Search
USPC ..... 134/167 R, 166 R, 22.1, 172, 198, 24, 134/103.2; 239/237, 240, 242, 206, 201, 239/380
See application file for complete search history.

(56) References Cited

U.S. PATENT DOCUMENTS

| | | | | |
|---|---|---|---|---|
| 5,169,069 | A * | 12/1992 | Rucker et al. | 239/227 |
| 6,988,676 | B2 | 1/2006 | Schreur et al. | |
| 2004/0238009 | A1 * | 12/2004 | Falster-Hansen et al. | 134/22.1 |
| 2007/0210191 | A1 | 9/2007 | Clifford | |
| 2008/0292230 | A1 * | 11/2008 | Hsieh et al. | 384/322 |

FOREIGN PATENT DOCUMENTS

| | | | |
|---|---|---|---|
| JP | 8024718 | A | 1/1996 |

* cited by examiner

*Primary Examiner* — Michael Barr
*Assistant Examiner* — Thomas Bucci
(74) *Attorney, Agent, or Firm* — Michael R. Philips

(57) ABSTRACT

A rotary impingement cleaning apparatus is configured for use in sanitary environments with a minimum of components to enable easy inspection and cleaning. The components of the cleaning apparatus are formed to fit relatively loosely to one another and promote self flushing and self drainage of cleaning liquid. A stator is mounted within a housing for diverting the flow of the pressurized cleaning liquid from axial to angular to impinge and rotationally drive a rotator stem or a rotor. The rotator stem or rotor causes an elbow to rotate around the vertical axis and a number of nozzles mounted to a nozzle housing to rotate around the horizontal axis.

20 Claims, 5 Drawing Sheets

ROTARY IMPINGEMENT CLEANING APPARATUS FOR SANITARY ENVIRONMENTS

RELATED APPLICATION

This application is a conversion of provisional application No. 61/278,067 filed on Oct. 2, 2009.

FIELD OF THE INVENTION

The present invention relates to the field of rotary impingement cleaning apparatus, and more particularly to rotary impingement cleaning apparatus adapted for use in sanitary environments such as processing or storage tanks for dairy products, pharmaceuticals or comestibles.

BACKGROUND OF THE INVENTION

The dairy, food and pharmaceutical industries use tanks for processing and for storing highly sensitive products. Common preparation processes may include blending, homogenizing, chilling, heating and pasteurizing. Food, cosmetic and pharmacologic ingredients are particularly susceptible to microbial contamination. In addition, process control requires avoiding of any unintended cross-contamination of components from one product type to another. Therefore, thoroughly cleaning of processing tanks between production batches and when changing product type is essential.

An industry standard for apparatus acceptable for use in cleaning process and storage tanks has been developed and is widely used. The standard is titled 3-A® Sanitary Standards for Spray Cleaning Devices Intended to Remain in Place, Number 78-01, as updated periodically (hereafter the 3-A Standard). The accepted 3-A Standard defines design parameters for cleaning apparatus to minimize the chance of the cleaning liquid being retained in the cleaning device, potentially encouraging bacterial growth. Exemplary design parameters include, inter alia, that all surfaces must be self draining and self flushing, all internal corners must be formed with a radius, interior surfaces must be polished, and no machine threads are permitted on any product or solution contacting surface. Acceptable apparatus must be easily disassembled for cleaning and inspection.

Current industry practice for conforming to the 3-A Standard has been to use a "spray ball" apparatus for cleaning tank interiors. A spray ball is essentially a hollow sphere having a pattern of small holes through the surface to function as nozzles and spray a liquid at the interior surface of the tank. The spray ball may be rotated or stationary. Spray balls have the advantage of not having internal moving parts, i.e. requiring little maintenance effort, but having the disadvantage of not being very effective for cleaning the interior walls of a tank.

A more effective cleaning device is the rotary impingement cleaning apparatus that has been used for cleaning industrial storage and process tanks. Examples of known rotary impingement cleaning apparatus are disclosed in U.S. Pat. Nos. 5,169,069 and 6,561,199. However, conventional rotary impingement cleaning apparatus do not conform to the 3-A Standard. A conventional rotary impingement cleaning apparatus typically has a complex internal mechanism, including either a worm gear transmission or a multiple stage planetary gear train, making self draining or self flushing of liquid and other 3-A Standard requirements unattainable.

Therefore, a need exists for an effective cleaning apparatus that conforms to the 3-A Standard for spray cleaning devices.

Major considerations in conformity to the 3-A Standard are optimum drainage and flushing of cleaning liquids, and ease of inspection and servicing. The invention disclosed herein provides a cleaning apparatus conforming to the 3-A Standard.

SUMMARY OF THE INVENTION

The invention rotary impingement cleaning apparatus described herein has a minimum of moving parts to encourage drainage of the cleaning liquid and to simplify inspection and service. The cleaning apparatus does not use the customary internal worm or planetary gear train drive. A pressurized liquid is connected to a housing inlet cap in a manner to pass through a stator. The stator diverts the flow path from axial to angular to form a vortex within the housing. The swirling liquid drives a rotator stem or a rotor. The rotating stem or rotor causes an elbow to rotate. A pair of bevel gears are mounted between the housing and a nozzle housing to cause a pair of nozzles to rotate around the horizontal axis as the nozzle housing rotates around the vertical axis. The bevel gears are formed with a round root shape to promote liquid draining in conformity with the 3-A Standard. Each of the parts having a substantially horizontal surface has been designed with those surfaces being angled downward to allow self drainage and self flushing. The bearings in the apparatus are sleeve bushings that are sized to fit loosely into and around other components to maximize drainage. The bushings are preferably made of a naturally lubricious resin, e.g. Teflon® or ultra-high molecular weight polyethylene. All machine threads are sealed to prevent contact with the stored product or the cleaning liquid.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
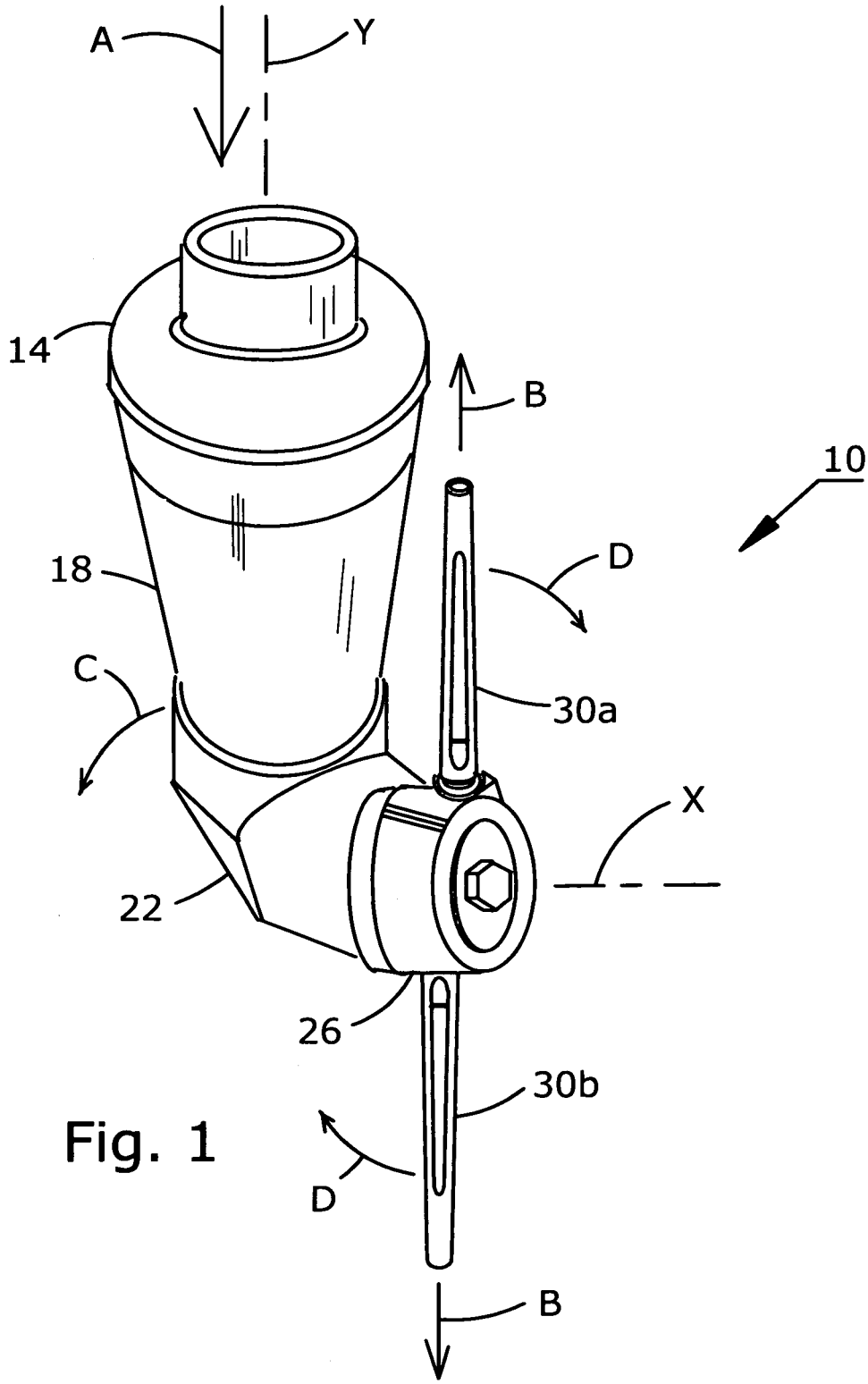
FIG. 1 is a front perspective view of the rotary impingement cleaning apparatus of the invention.

Referring to FIG. 1, the rotary impingement cleaning apparatus of the present invention is designated generally by numeral 10. Cleaning apparatus 10 is typically oriented for use with axis Y substantially vertical and axis X substantially horizontal. A pressurized cleaning liquid is introduced into cleaning apparatus 10 through inlet cap 14 in the direction indicated by arrow A and discharged from cleaning apparatus 10 through nozzles 30*a* and 30*b* in the directions indicated by arrows B. Inlet cap 14 is fixedly mounted to an entry of a housing 18. An elbow 22 is mounted to an exit of housing 18 in a manner to allow elbow 22 to rotate around axis Y relative to housing 18. A nozzle housing 26 is mounted to elbow 22 in a manner to allow nozzle housing 26 to rotate around axis X relative to elbow 22. Therefore, housing 18 remains stationary while elbow 22 rotates around axis Y and nozzle housing 26 rotates around axis X. Nozzles 30*a*, 30*b* are fixedly mounted to nozzle housing 26 to rotate with elbow 22. The cleaning liquid enters the apparatus through inlet cap 14 as indicated by arrow A and drives the apparatus to cause elbow 22 to rotate in the direction indicated by arrow C and nozzles 30*a*, 30*b* to rotate with nozzle housing 26 in the direction indicated by arrow D. With elbow 22 being rotated around vertical axis Y and nozzles 30*a*, 30*b* being rotated around horizontal axis X, the cleaning liquid streams being sprayed from nozzles 30*a*, 30*b* describe a spherical pattern to impinge all interior portions of a tank being cleaned.

Figure 2:
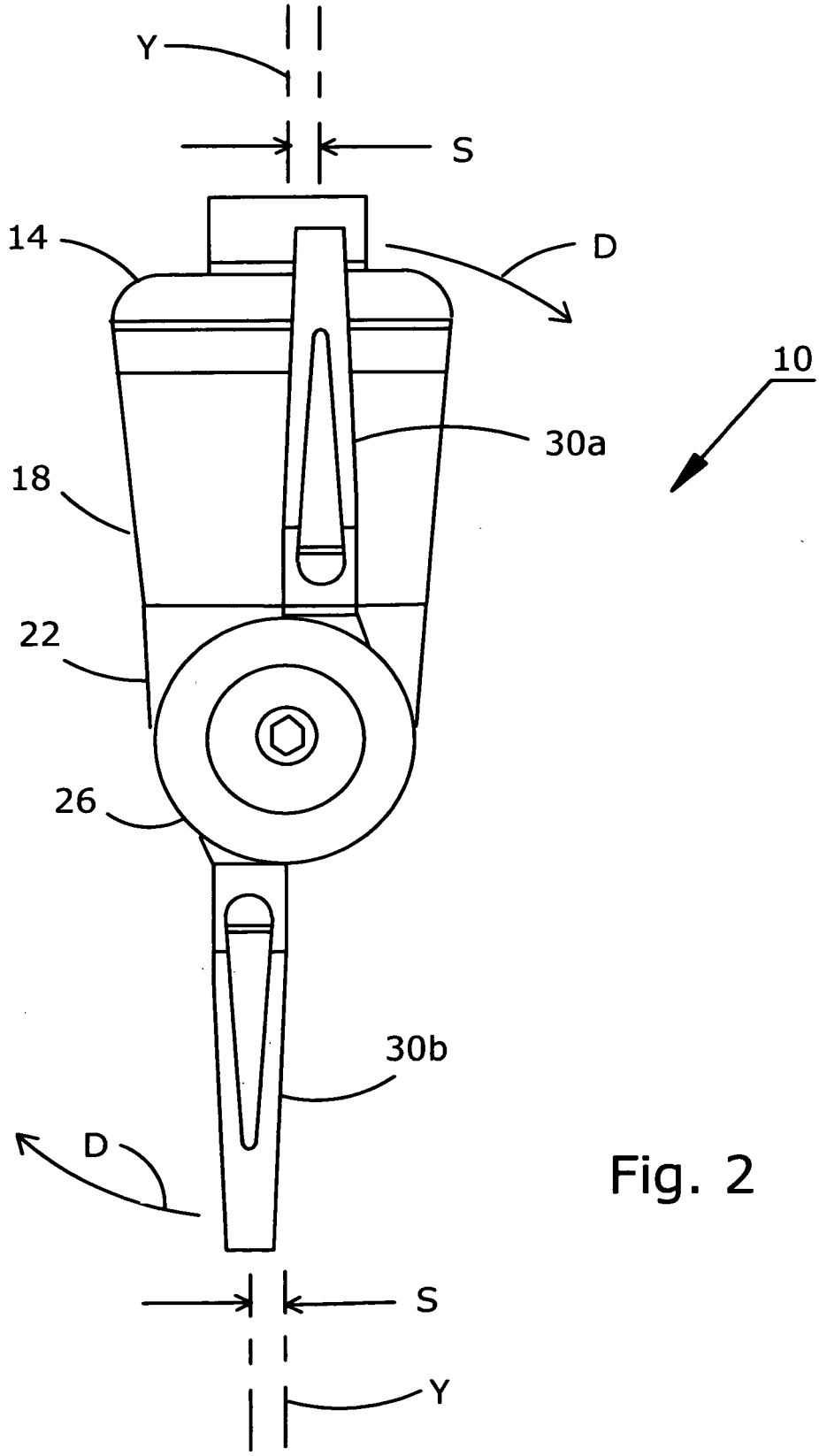
FIG. 2 is a front elevation view of the apparatus of FIG. 1.

Referring now to FIG. 2, rotary impingement cleaning apparatus 10 is shown in front elevation view. Vertical axis Y passes through the center of apparatus 10, and more particularly through the center of rotation of nozzle housing 26. It is noted that placing a nozzle for spraying a pressurized liquid in a position offset from the center of rotation will either increase or decrease the nozzle rotational speed. As clearly shown in this figure, nozzle 30*a* is oriented parallel to, and offset from, vertical axis Y by a horizontal distance S to the right (as illustrated), or clockwise. Similarly, nozzle 30*b* is oriented parallel to, and offset from, vertical axis Y by a horizontal distance S to the left, or clockwise. With nozzles 30*a* and 30*b* positioned offset from the center of rotation of nozzle housing 26 in the clockwise direction, the forces created by spraying a pressurized cleaning liquid from nozzles 30*a*, 30*b* will assist, or increase the speed of, the rotation of nozzle housing 26 and nozzles 30*a*, 30*b* in the clockwise direction as indicated by arrows D. It is further to be understood that if the nozzles were positioned offset in the counterclockwise direction from the center of rotation, and the mechanism within the cleaning apparatus were driving in the clockwise direction, the forces created by the spray would act to retard rotational speed.

Figure 3:
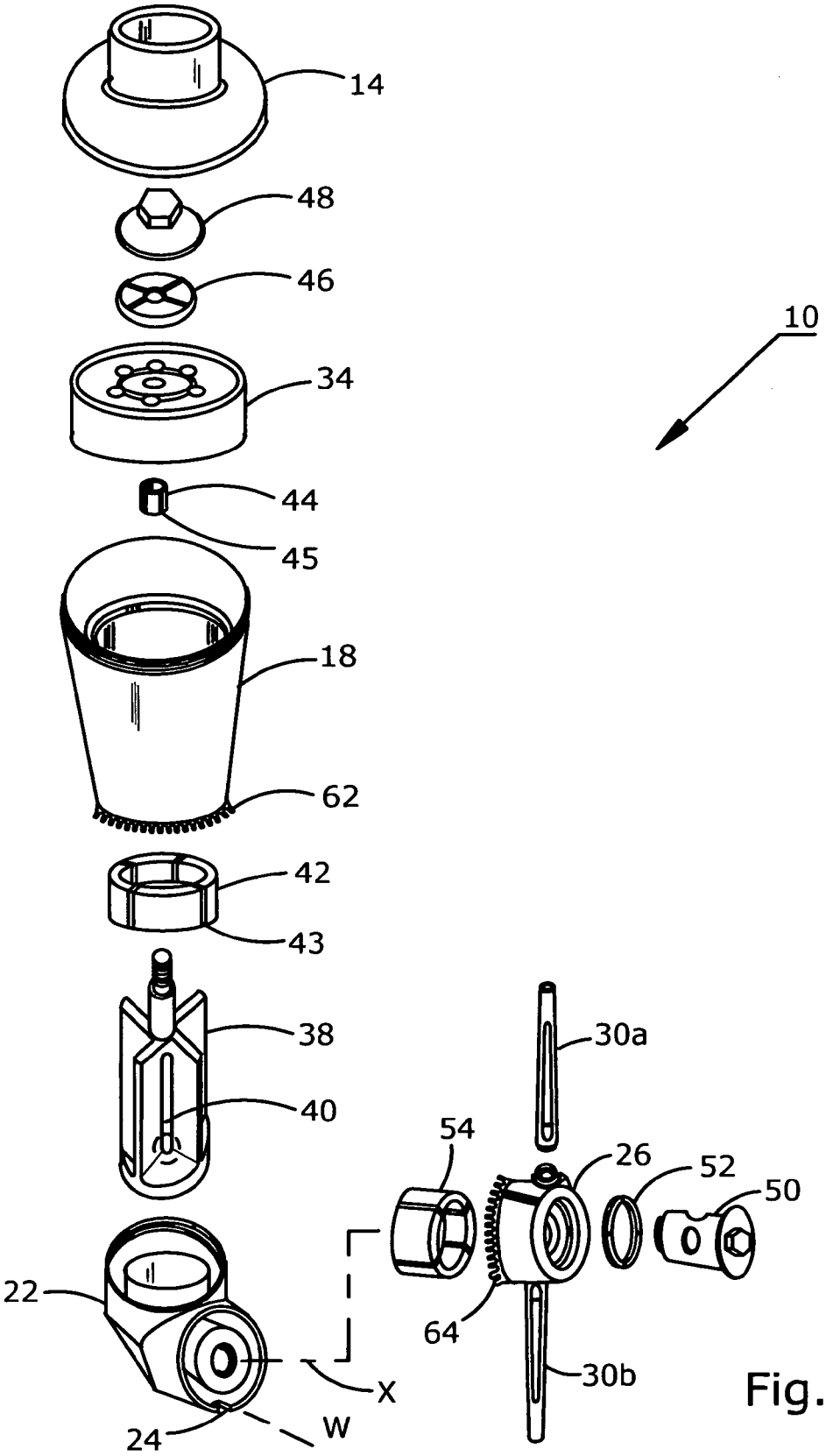
FIG. 3 is an exploded perspective view of the apparatus of FIG. 1.

Referring now to FIG. 3, apparatus 10 is shown in exploded perspective view. For reasons of simplicity and clarity, sealing components to be used between several components, e.g. "O" rings, are not shown in FIG. 3. The description to follow proceeds in a typical sequence of assembly. A rotator stem 38 is fixedly assembled to elbow 22, for example by mating threaded portions thereof, to cause elbow 22 to rotate with rotator stem 38. In an alternate embodiment of the invention, a rotor (to be described below) is mounted to a conventional stem in place of the integral rotator stem 38. A tubular bushing 42 is loosely mounted to rotator stem 38. All bushings in the invention apparatus are configured to loosely engage surrounding or internal mating components to enhance self flushing and liquid drainage. It has been determined that a difference in diameter appropriate to self flushing and drainage is established with the outside diameter of the inner component approximately 0.035 inches smaller than the inside diameter of the outer component. The bushings are preferably made of a naturally lubricious resin that conforms to the 3-A Standard, e.g. Teflon® or ultra-high molecular weight polyethylene. All machine threads are sealed, e.g. with an FDA approved silicone compound, to prevent contact with the stored product or a cleaning liquid. Elbow 22 is formed with an inclined lower lip oriented at an angle W below horizontal axis X and a drain notch 24 to allow any liquid to drain freely out of cleaning apparatus 10.

Referring further to FIG. 3, a large bushing 54 is inserted into the lower chamber of elbow 22. A bevel gear 64 is affixed to nozzle housing 26. Nozzle housing 26 is then mounted to large bushing 54 and a discharge stem 50 is passed through a thrust bushing 52 and through nozzle housing 26 to threadingly engage elbow 22. As noted above, large bushing 54 and thrust bushing 52 are sized to fit loosely within nozzle housing 26 and over discharge stem 50 to enable a free flow of liquid. Discharge stem 50 is formed with a hollow core and radial exit holes to direct cleaning liquid exiting through elbow 22 to flow into nozzle housing 26. Nozzles 30*a* and 30*b* are then mounted into holes formed in the outer periphery of nozzle housing 26, preferably by matching machine threads. Alternatively, nozzle housing 26 can be formed with a plurality of integrally formed nozzle holes or flush mounted short nozzles, as is known in the trade.

Continuing with reference to FIG. 3, housing 18 has a bevel gear 62 affixed thereto. Housing 18 is placed over bushing 42 and rotating stem 38 with bevel gear 62 of housing 18 engaging bevel gear 64 of nozzle housing 26. A small bushing 44 is fitted loosely over the upper shaft of rotator stem 38 and a stator 34 is fitted loosely over small bushing 44. The outer diameter of stator 34 fits snugly into the upper portion of housing 18. A flat bearing 46 is then placed over the extending upper shaft end of rotator stem 38, and a nut 48 is fixedly threaded thereto. Inlet cap 14 is assembled, e.g. by threads formed on the exterior surface of housing 18 and the inside of inlet cap 14, to enclose the apparatus. All bushings assembled in rotary impingement cleaning apparatus 10 of the invention may, optionally, be formed with a series of channels on outer surfaces thereof, e.g. channel 43 of bushing 42 and channel 45 of bushing 44, to assist in draining and flushing liquids from the apparatus. If drain channels are used, the drainage and flushing clearance provided between inner and outer components may be adjusted.

Figure 4:
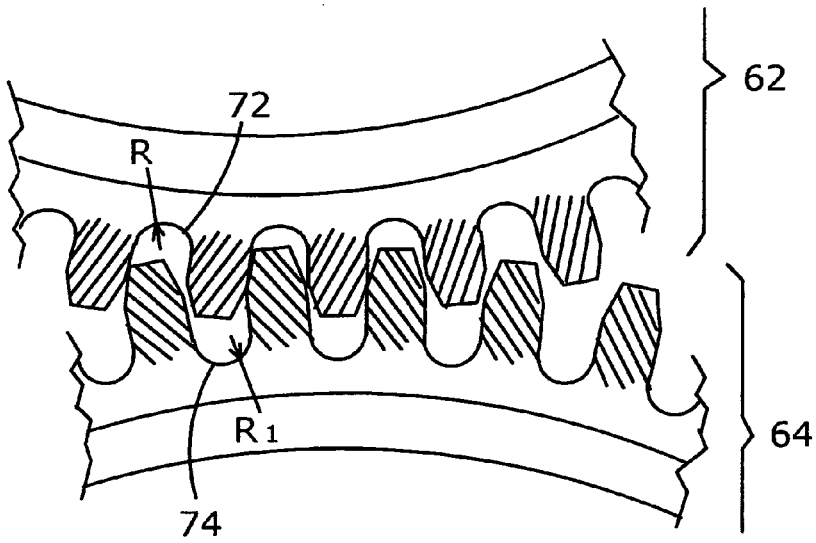
FIG. 4 is an enlarged partial view of mating bevel gears of the invention showing the round root shape thereof.

Referring now to FIG. 4, an enlarged partial section of bevel gear 62 is shown in driving engagement with an enlarged partial section of bevel gear 64. The bodies of the gear teeth are illustrated with hatch lines for clear visibility. Whereas known gear tooth profiles are typically formed with the root contour being the mirror image of the crown contour, the gear teeth of the invention disclosed are formed with root 72 of bevel gear 62 having a radius R and root 74 of bevel gear 64 having a radius $R_1$. Radii R and $R_1$, formed at the roots of bevel gears 62 and 64 provides a further measure to encourage self flushing and free drainage without retaining liquid at inside corners. Radii R and $R_1$ are preferably at least 0.3125 inch. Radii R and $R_1$ are preferably substantially equal to one another. The crowns of the teeth of bevel gears 62 and 64 are conventionally formed with angled pressure surfaces and angulated corners. Bevel gears 62 and 64 have different pitch diameters, and therefore different numbers of teeth, in order to cause nozzle housing 26 (see FIG. 1) to rotate around horizontal axis X at a different speed than elbow 22 rotates around vertical axis Y. This pitch difference creates a varying spray pattern that advances in each successive cycle to thoroughly clean the entire interior surface of the tank being cleaned. In a particular preferred embodiment of the invention, bevel gear 62 is formed with 59 teeth and bevel gear 64 is formed with 61 teeth. The cleaning apparatus of the invention is therefore caused to rotate in two orthogonal planes by use of a simple bevel gear transition and without the previously known planetary or worm gear systems. This simplified mechanism is beneficial to the inspection and cleaning processes needed in a sanitary environment, and particularly as required by the 3-A Standard.

Figure 5:
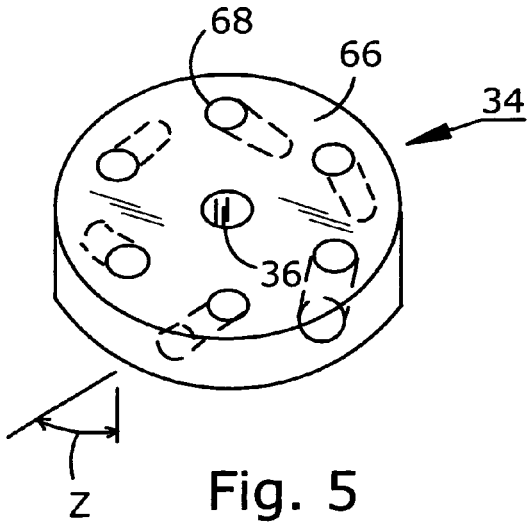
FIG. 5 is a top perspective view of a stator of the invention apparatus.
Figure 5A:
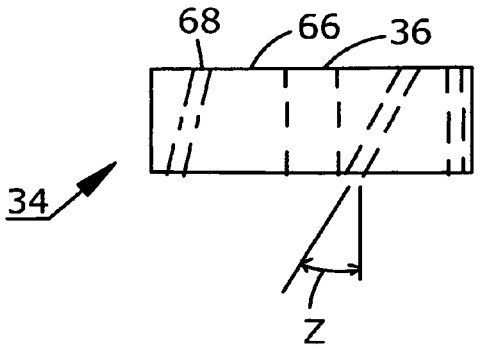
FIG. 5A is a front elevation view of the stator of FIG. 5.

Referring now to FIGS. 5 and 5A, stator 34 is shown in top perspective view and side elevation view, respectively. Stator 34 is positioned in cleaning apparatus 10 (see FIG. 3) at the upper portion thereof to divert incoming cleaning liquid from a straight, vertical flow to an angled, rotating flow. Stator 34 is formed with a plurality of diverter channels 68 from a top surface 66 through the body of stator 34. Stator 34 may be formed with three to six diverter channels 68. Diverter channels 68 are oriented at an angle Z to vertical, angle Z being in the range of between 30° and 50°, most preferably at an angle of approximately 45°. A central bore 36 is formed through stator 34 to allow the shaft of rotator stem 38 to be passed through. With channels 68 angularly oriented, the flow path of the pressurized cleaning liquid flowing through housing 18 (see FIG. 3) is diverted from a line that is parallel to vertical axis Y to approximately follow angle Z. The effect on the pressurized cleaning liquid of being discharged from stator 34 channels 68 at approximately angle Z is to swirl the liquid into a vortex through the lower portion of housing 18.

Figure 6:
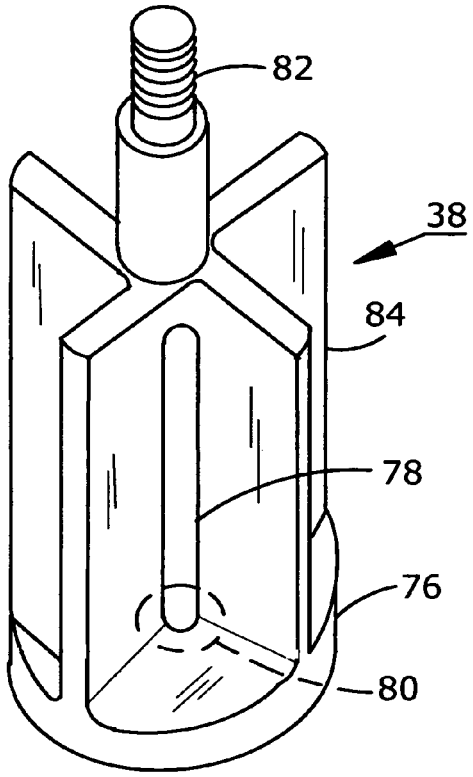
FIG. 6 is a front perspective view of a rotator stem of the invention cleaning apparatus.
Figure 6A:
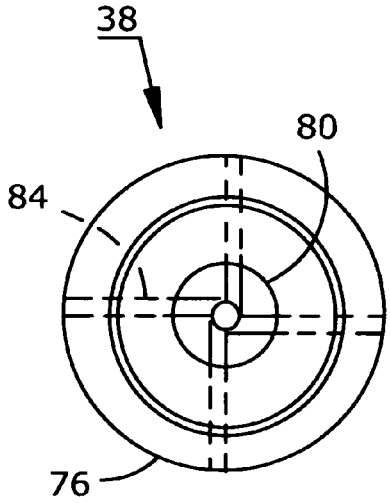
FIG. 6A is a bottom plan view of the rotator stem of FIG. 6.

Referring now to FIGS. 6 and 6A, a rotator stem 38 is shown in top perspective view and bottom plan view, respectively. Rotator stem 38 is formed with a plurality, e.g. four, laterally extending, vertically oriented, vanes 84 that terminate at a horizontal base 76. In the preferred embodiment, vanes 84 are offset with a first surface being substantially radial and a second surface being spaced from, and parallel to, the first surface. The outer edges of vanes 84 are formed with a radius similar to the radius of base 76. Different numbers of vanes 84, e.g. three vanes or five vanes, as well as vanes being geometrically different, e.g. helical, are considered within the scope of the invention. Vanes 84 are each driven by the vortex of cleaning liquid flowing from stator 34 (see FIG. 3) to cause rotator stem 38 to rotate. A vertically extending opening 78 is maintained at the center of rotator stem 38 where vanes 84 converge. Opening 78 is in fluid communication with an open base drain 80 through base 76. Base 76 of rotator stem 38 is fixedly attached to elbow 22 (see FIG. 3), e.g. by mating machine threads (not shown), causing elbow 22 to rotate as rotator stem 38 rotates. Rotator stem 38 is therefore provided as a unitary component having plural vanes 84 and a vertical flow opening 78 connected to a base drain 80. This configuration allows the cleaning liquid, after rotationally driving rotator stem 38, to pass into vertical opening 78 and down through base drain 80, flowing then into elbow 22, into nozzle housing 26 to be discharged through nozzles 30*a* and 30*b*. Rotator stem 38 is formed with a threaded connector 82 for assembly to nut 48 (see FIG. 3).

Figure 7:
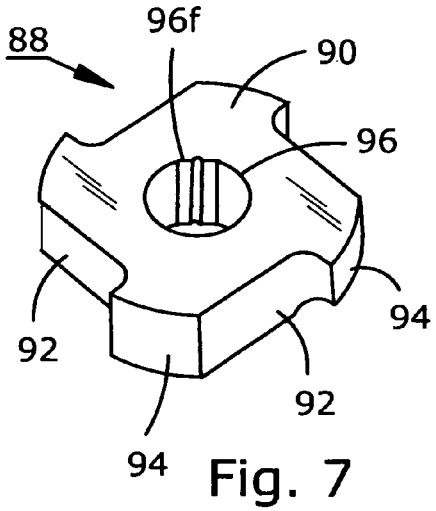
FIG. 7 is a top perspective view of an optional rotor for use with a non-rotating stem.
Figure 7A:
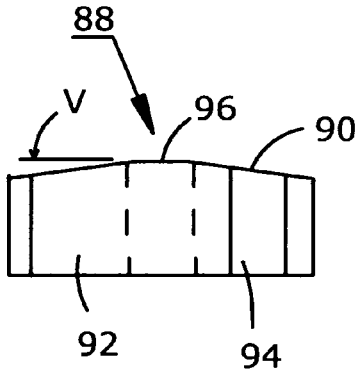
FIG. 7A is a front elevation view of the optional rotor of FIG. 7.

Referring now to FIGS. 7 and 7A, an alternate configuration of the present invention employs a separate rotor 88 that is mounted to a flow through stem (not shown), as is known. Rotor 88 is formed with a plurality of lobes 94 that protrude from the main body of rotor 88 and are displaced from one another by equal angles, e.g. four lobes at 90° separation. A sidewall 92 connects each lobe 94 to adjacent lobes 94. The upper surface of rotor 88 is formed with a slope at an arbitrary angle V, in the range of 5° to 10°, in order to encourage drainage and self flushing. A bore 96, with a flat portion 96*f*, is formed in the center of rotor 88 to mount onto, and rotate with, the stem. Depending on the configuration and mounting of the stator 34 (see FIGS. 5, 5A), pressurized liquid may be directed either against sidewalls 92 or lobes 94 of rotor 88.

Referring again to FIGS. 1 and 3, with the rotary impingement cleaning apparatus 10 fully assembled as described above, a source of pressurized cleaning liquid is connected to inlet cap 14. The cleaning fluid passes through inlet cap 14 to be diverted from axial to angular by stator 34 and causes rotator stem 38 to rotate elbow 22 in the direction of arrow C around vertical axis Y while housing 18 remains stationary. The rotation of elbow 22 causes meshed bevel gears 62 and 64 to rotate nozzle housing 26 in the direction shown by arrows D around horizontal axis X. Therefore, it is seen that the cleaning liquid is discharged from nozzles 30*a* and 30*b* in the direction indicated by arrows B.

The present invention rotary impingement cleaning apparatus fulfills the primary requirements by providing effective cleaning of the interior surfaces of tanks. With an input liquid pressure of between approximately 20 to 80 psi, apparatus 10 sprays cleaning liquid at a flow rate of approximately 20 to 70 gallons per minute. The resultant cycle speed of nozzles 30*a* and 30*b* is between approximately 3 to 7 rpm. In addition, by having a minimum of internal mechanism, components fitted together loosely, no sharp internal angles, apparatus 10 is self flushing, drains readily and is easily assembled and disassembled.

While the description above discloses preferred embodiments of the present invention, it is contemplated that numerous variations and modifications of the invention are possible and are considered to be within the scope of the claims that follow.

What is claimed is:

1. A rotary impingement cleaning apparatus for sanitary environments, comprising:

a. a housing having a first axis;

b. an inlet cap mounted to the housing for introducing a pressurized cleaning liquid therethrough;

c. a stator affixed within the housing concentric with the first axis at an upstream end thereof, the stator being configured for changing the flow path of the cleaning liquid;

d. a rotator stem rotatably mounted within the housing to be concentric with the first axis and downstream of the stator, the rotator stem being rotationally driven by the cleaning liquid;

e. an elbow having a first portion aligned with the first axis and a second portion having a second axis, the elbow mounted to the rotator stem for rotation therewith as driven by the cleaning liquid;

f. a nozzle housing rotatably connected to the second portion of the elbow for rotation around the second axis;

g. nozzle means for discharging the cleaning liquid outward from the nozzle housing;

h. gear means for causing the nozzle housing to rotate around the second axis as the elbow rotates around the first axis;

i. whereas the pressurized cleaning liquid enters the housing, passes through the stator, drives the rotator stem to rotate, passes through the elbow into the nozzle housing, and is discharged through the nozzle means to impinge inner surfaces of a tank being cleaned; and j. whereas mating components of the cleaning apparatus fit together loosely to enhance self flushing and liquid drainage.

2. The rotary impingement cleaning apparatus described in claim 1, wherein the nozzle means for discharging liquid outward from the nozzle housing comprises a plurality of nozzles fixedly connected to the nozzle housing.

3. The rotary impingement cleaning apparatus described in claim 2, wherein each of the nozzles is mounted to the nozzle housing in a position to affect the rotational velocity of the nozzle housing.

4. The rotary impingement cleaning apparatus described in claim 3, wherein the nozzles are offset from a center of rotation of the nozzle housing in a direction to cause an increase in the rotational velocity of the nozzle housing.

5. The rotary impingement cleaning apparatus described in claim 1, wherein the gear means for causing the nozzle housing to rotate around the second axis comprises a first bevel gear fixedly connected to the housing and a second bevel gear fixedly connected to the nozzle housing, the second bevel gear engaging the first bevel gear.

6. The rotary impingement cleaning apparatus described in claim 5, wherein the first and second bevel gears are formed with round root contours.

7. The rotary impingement cleaning apparatus described in claim 1, further comprising a plurality of bushings, wherein mating components of the apparatus fit loosely together to provide a gap for self flushing and self drainage.

8. The rotary impingement cleaning apparatus described in claim 7, wherein a difference between the outside diameter of an inner component and the inside diameter of a mating outer component is approximately 0.035 inches.

9. The rotary impingement cleaning apparatus described in claim 7, further comprising forming the bushings with surface grooves for self flushing and self drainage of liquid from the apparatus.

10. A rotary impingement cleaning apparatus for sanitary environments, comprising:

a. a housing having a first axis;

b. an inlet cap mounted to the housing for introducing a pressurized cleaning liquid therethrough;

c. a stator affixed within the housing concentric with the first axis at an upstream end thereof, the stator being configured for changing the flow path of the cleaning liquid;

d. a rotor mounted within the housing to be concentric with the first housing axis and downstream of the stator, the rotor being rotationally driven by the cleaning liquid;

e. a stem mounted at an upper end thereof to the rotor;

f. an elbow having a first portion aligned with the first axis and a second portion having a second axis, the elbow mounted to a lower end of the rotating stem for rotation therewith as driven by the cleaning liquid;

g. a nozzle housing rotatably connected to the elbow in alignment with the second axis;

h. nozzle means for discharging liquid outward from the nozzle housing;

i. gear means for causing the nozzle housing to rotate around the second elbow axis as the elbow rotates around the first axis;

j. whereas mating components of the apparatus fit loosely together to provide a gap for self flushing and self drainage; and k. whereas the pressurized cleaning liquid enters the housing, passes through the stator, drives the rotor and stem to rotate, passes through the elbow into the nozzle housing, and is discharged through the nozzle means for discharging liquid to impinge inner surfaces of a tank being cleaned.

11. The rotary impingement cleaning apparatus described in claim 10, wherein the nozzle means for discharging liquid outward from the nozzle housing comprises a plurality of nozzles fixedly connected to the nozzle housing.

12. The rotary impingement cleaning apparatus described in claim 11, wherein each of the nozzles is mounted to the nozzle housing in a position to affect the rotational velocity of the nozzle housing.

13. The rotary impingement cleaning apparatus described in claim 12, wherein the nozzles are mounted to increase the rotational velocity of the nozzle housing.

14. The rotary impingement cleaning apparatus described in claim 10, wherein the gear means for causing the nozzle housing to rotate around the second axis comprises a first bevel gear fixedly connected to the housing and a second bevel gear fixedly connected to the nozzle housing, the second bevel gear engaging the first bevel gear.

15. The rotary impingement cleaning apparatus described in claim 14, wherein the first and second bevel gears are formed with round root contours.

16. The rotary impingement cleaning apparatus described in claim 10, further comprising a plurality of bushings, wherein mating components of the apparatus fit loosely together to provide a gap for self flushing and self drainage.

17. The rotary impingement cleaning apparatus described in claim 16, wherein a difference between the outside diameter of an inner component and the inside diameter of a mating outer component is approximately 0.035 inches.

18. The rotary impingement cleaning apparatus described in claim 17, further comprising forming the bushings with surface grooves for self flushing and self drainage of liquid from the apparatus.

19. The rotary impingement cleaning apparatus described in claim 1, wherein the stator is formed with a plurality of angularly oriented diverter channels therethrough and wherein the rotator stem is formed with a plurality of vanes positioned to receive a flow of cleaning liquid passing through the stator diverter channels to cause the rotator stem to rotate.

20. The rotary impingement cleaning apparatus described in claim 19, wherein the vanes are formed with a first surface extending substantially in a radial direction and a second surface that is parallel to and spaced apart from the first surface.

* * * * *